US007422067B2

(12) United States Patent
Fouras et al.

(10) Patent No.: US 7,422,067 B2
(45) Date of Patent: Sep. 9, 2008

(54) DEPLOYING AN ASSEMBLY INTO A WELL

(75) Inventors: James Fouras, Soldotna, AK (US); Joseph Young, Kenai, AK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 260 days.

(21) Appl. No.: 11/114,837

(22) Filed: Apr. 26, 2005

(65) Prior Publication Data

US 2005/0236153 A1 Oct. 27, 2005

Related U.S. Application Data

(60) Provisional application No. 60/565,576, filed on Apr. 27, 2004.

(51) Int. Cl.
*E21B 43/04* (2006.01)

(52) U.S. Cl. ..... 166/369; 166/278; 166/227

(58) Field of Classification Search ..... 166/278, 166/369, 227, 297
See application file for complete search history.

(56) References Cited

U.S. PATENT DOCUMENTS 6,056,055 A * 5/2000 Falconer et al. ..... 166/297
6,206,100 B1 * 3/2001 George et al. ..... 166/278
6,220,353 B1 * 4/2001 Foster et al. ..... 166/278
6,601,648 B2 8/2003 Ebinger ..... 166/297
6,640,897 B1 * 11/2003 Misselbrook et al. ..... 166/278
2003/0141079 A1 * 7/2003 Doane et al. ..... 166/387

FOREIGN PATENT DOCUMENTS

| | | |
|---|---|---|
| CA | 2 299 580 | 8/2000 |
| RU | 2131025 | 5/1999 |
| SU | 588345 | 1/1978 |
| SU | 933954 | 6/1982 |
| WO | 01/49970 | 7/2001 |

* cited by examiner

*Primary Examiner*—David J. Bagnell
*Assistant Examiner*—Nicole Coy
(74) *Attorney, Agent, or Firm*—David Cate; Tim Curington; Robin Nava

(57) ABSTRACT

A technique that is usable with a well includes running an isolation device into the well and using the isolation device to form a seal to create a first region of the well isolating the surface of the well from a second higher pressure region of the well. The technique includes running an assembly into the first region and engaging the isolation device with the assembly to remove the seal. After removal of the seal, the isolation device and assembly are run together further into the well.

22 Claims, 9 Drawing Sheets

DEPLOYING AN ASSEMBLY INTO A WELL

This application claims the benefit pursuant to 35 U.S.C. § 119(e) to U.S. Provisional Application Ser. No. 60/565,576, filed on Apr. 27, 2004.

BACKGROUND

The invention generally relates to deployment of an assembly, such as a screen assembly, into a well.

A typical subterranean well includes particulates, often referred to as "sand," that may constrict downhole production flow paths. Furthermore, the sand, given the high pressure in the well, may erode downhole production equipment. Thus, a typical subterranean well may rely on a filtering substrate of gravel to separate the sand from the well fluid downhole in the well.

More particularly, the well typically includes a cylindrical screen that forms a barrier to radially retain the gravel between the screen and the formation. The interior of the screen is in fluid communication with a central passageway of a production tubing string. Thus, the gravel filters the sand from the well fluid, and the screen prevents the gravel from entering the interior of the screen. Due to this arrangement, the well fluid flows through the gravel, into the interior of the screen and into the central passageway of a production tubing to the surface of the well.

Challenges typically arise in installing the screen in a well that has positive surface pressure. Conventional techniques to install the screen include "killing" the well by introducing a heavy weight fluid into the well to balance the pressure that is exerted by the well. Another technique involves using relatively short screen assemblies and inserting these screen assemblies through a lubricator of the well.

However, conventional techniques to install the screen may involve a considerable amount of time and may involve the use of relatively expensive workover fluids and equipment. Therefore, there exists a continuing need for a better system and/or technique to install an assembly, such as a screen assembly in a well.

SUMMARY

In an embodiment of the invention, a technique that is usable with a well includes running an isolation device into the well and using the isolation device to form a seal to create a first region of the well isolating the surface of the well from a second higher pressure region of the well. The technique includes running an assembly into the first region and engaging the isolation device with the assembly to remove the seal. After the removal of the seal, the isolation device and assembly are run together further into the well.

Advantages and other features of the invention will become apparent from the following description, drawing and claims.

DETAILED DESCRIPTION

Figure 1:
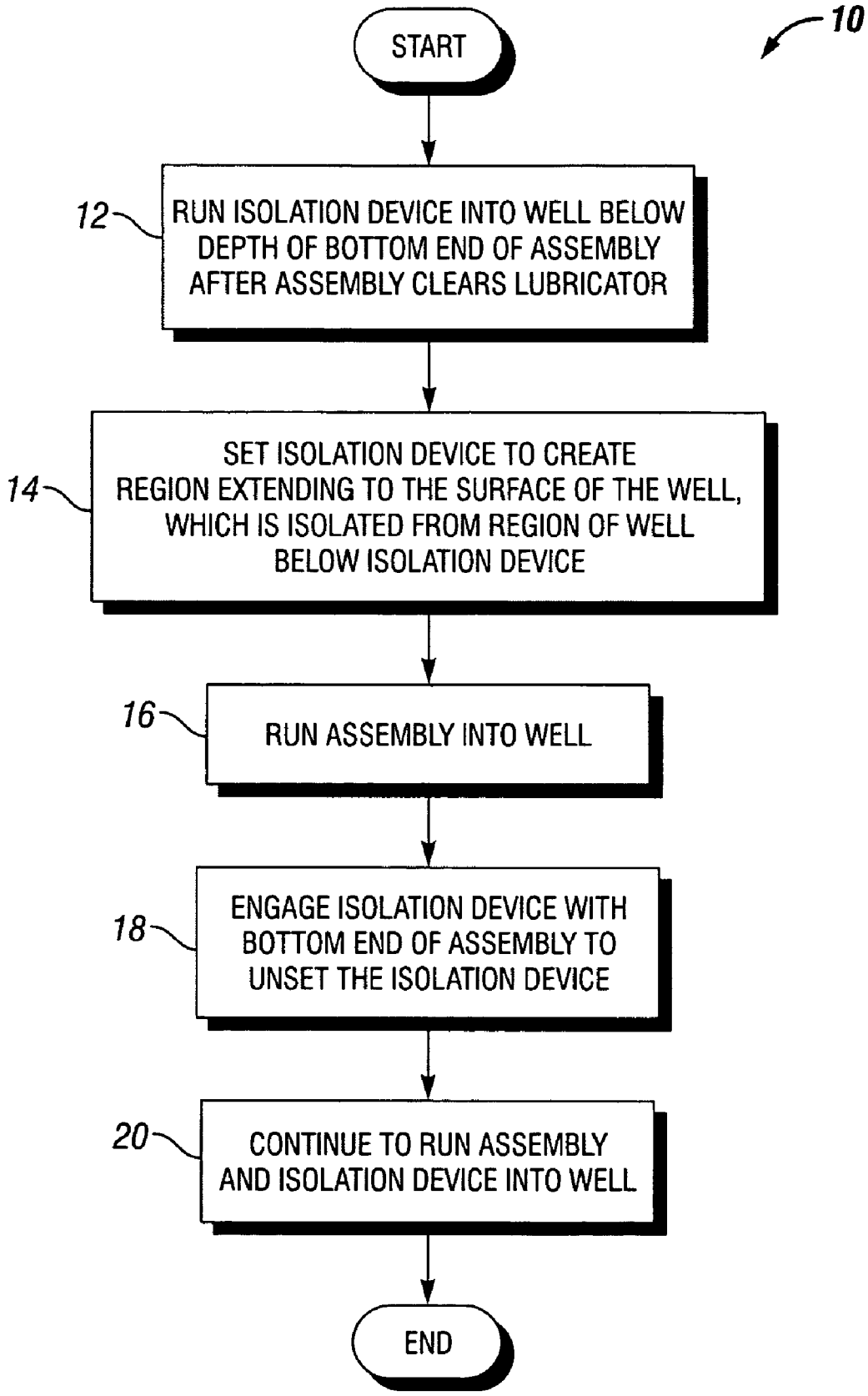
FIG. 1 is a flow diagram depicting a technique to deploy an assembly into a well according to an embodiment of the invention.

Referring to FIG. 1, a technique 10 may be used for purposes of installing an assembly into a subterranean well that has a positive surface pressure. The assembly may be an isolation subsystem that, only positioned downhole, may be activated to isolate the subsystem from other parts of the well. The assembly may have one or more segments (poroous segments, for example) that do not form adequate seals with the well's lubricator as the assembly is being deployed downhole. However, due to the technique 10, the lubricator's seal is not relied on to isolate the positive pressure of the well from the surface of the well.

The technique 10 involves establishing an isolation zone near the surface of the well to receive the assembly. The isolation zone is a pressure buffer region to isolate the surface of the well from the well pressure below the zone. Therefore, the assembly may be deployed into the well, through the well's lubricator and into the isolation zone without requiring a seal to be formed between the lubricator and the assembly. After the assembly is fully received within the isolation zone, the zone is removed to allow further deployment of the assembly downhole.

More particularly, pursuant to the technique 10, an isolation device is run (block 12) into the well until the isolation device reaches a depth that is the bottom end of the to-be-created isolated zone. Thus, this depth is at or below the depth that the bottom end of the assembly reaches after the assembly clears the lubricator and is fully received in the isolation zone. The isolation device is then set (block 14) to form the bottom end of the isolation zone. Subsequently, the assembly is run into the isolation zone. After the assembly clears the lubricator, the lubricator seals off the isolated zone from the surface of the well so that the isolation device may be unset to remove the seal and thus, remove the isolation zone.

In this regard, pursuant to the technique 10, the assembly is run (block 16) into the well until the assembly engages (block 18) the isolation device. This engagement, in turn, is used to unset the isolation device, to free the isolation device for movement, as well as removing the previously-created seal by the isolation device. The assembly and isolation device (attached to the bottom of the assembly) then continue to be run (block 20) into the well pursuant to the technique 10.

As a more specific example, in some embodiments of the invention, the assembly may be a screen assembly that is used (when fully installed) to radially retain a filtering gravel substrate in a particular zone of the well. The screen assembly contains a screen that is relatively porous and may not form a sufficient seal to the well's lubricator. However, using the technique 10, the screen assembly may be run into the well without using a heavy weight fluid to kill the well or without deploying the screen assembly into the well in smaller segments. To further illustrate the technique 10 in conjunction with a screen assembly, FIG. 2 depicts a subterranean well 50 in accordance with an embodiment of the invention.

The subterranean well 50 includes a wellbore that may be lined with a well casing string 52, although the well 50 may be uncased, in some embodiments of the invention. A production tubing string 54 extends through the passageway that is defined by the casing string 52. As shown in FIG. 2, in some embodiments of the invention, an annular seal 56 may be formed between the exterior of the production tubing string 54 and the interior surface of the casing string 52.

Figure 2:
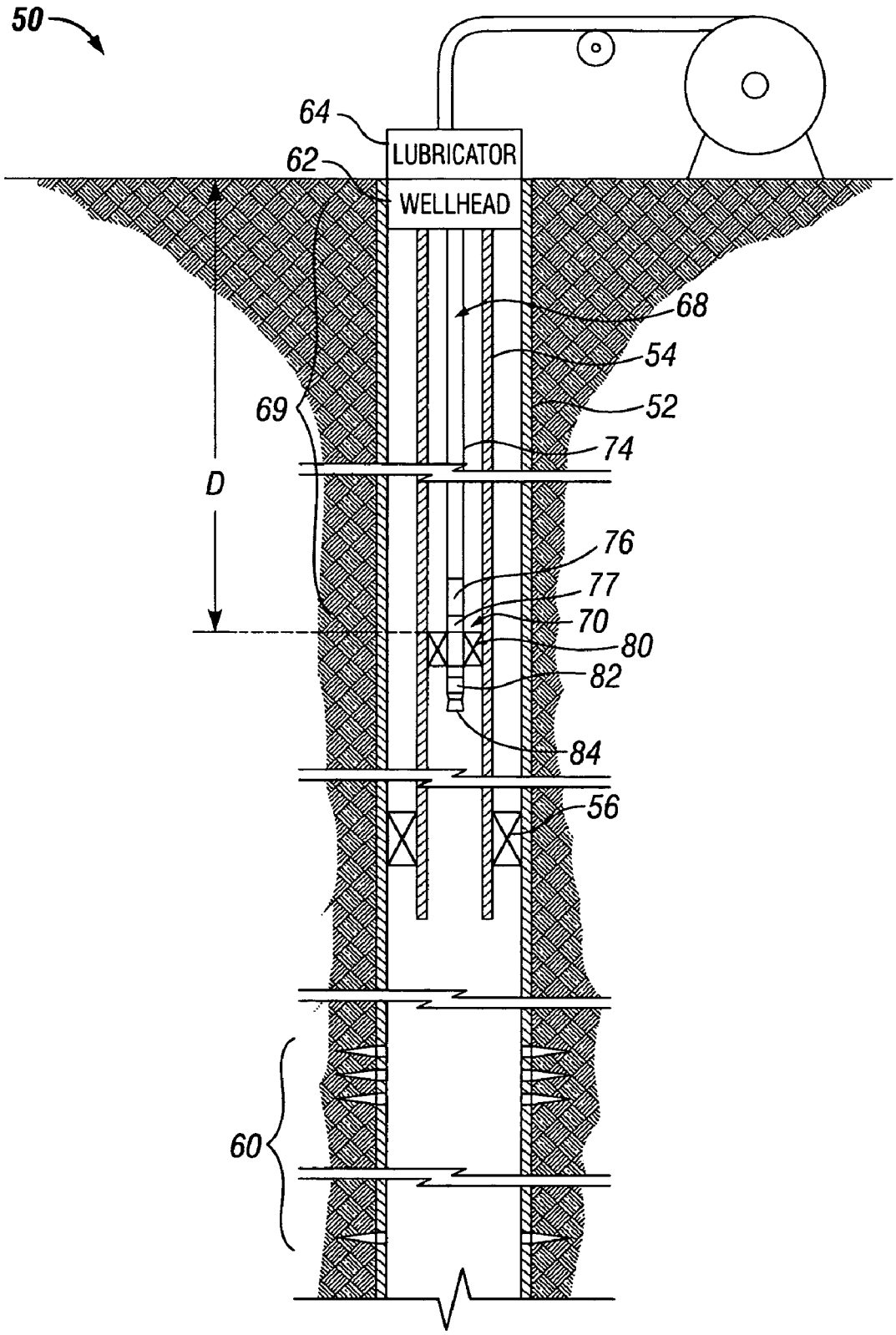
FIGS. 2 and 3 are schematic diagrams of a well depicting the installation of an isolation device to isolate well pressure from a surface of the well according to an embodiment of the invention.

The well 50 includes one or more production zones, such as an exemplary production zone 60 that is depicted in FIG. 2. The production zone 60 includes one or more perforations that are formed in the casing string 52, and one or more corresponding perforation tunnels that extend into the surrounding formation. As described in connection with FIGS. 2-7 below, a screen (not depicted in FIG. 2) is installed in the production zone 60 and retains a filtering gravel substrate in the zone 60. Thus, well fluid flows through the gravel where sand is removed from the fluid. The filtered fluid enters the interior of the screen and flows on through the central passageway of the production tubing string 54 to the surface of the well. The screen is part of a screen assembly (also not depicted in FIG. 2) that is run downhole pursuant to the technique 10 (FIG. 1).

More particularly, to install the screen, an isolation zone 69 is first formed near the surface of the well 50 to receive the screen assembly that contains the screen. The isolation zone 69 is formed using an isolation device, such as a packer 70, in accordance with some embodiments of the invention. The packer 70 has a central passageway and an annular sealing element 80 for purposes of forming a seal between the exterior of the packer 70 and the interior surface of the production tubing string 54. It is noted that the packer 70 is one out of many different types of isolation devices that may be used in accordance with the various embodiments of the invention. For example, in other embodiments of the invention, a bridge plug may be used in place of the packer 70.

In some embodiments of the invention, the packer 70 is run downhole (inside the central passageway of the production tubing string 54) on a tubing string 68. In accordance with some embodiments of the invention, the tubing string 68 may be a coiled tubing string, although other types of strings (a jointed string, for example) may be used in other embodiments of the invention. Furthermore, in accordance with the various embodiments of the invention, the tubing string 68 may be replaced by another conveyance device, such as a wireline, slickline, etc., depending on the particular embodiment of the invention.

For the embodiment of the invention depicted in FIG. 2, the packer 70 is located on the lower end of the string 68 and is lowered downhole until the packer 70 reaches a depth (called "D," in FIG. 2), the depth of the bottom of the to-be-formed isolation zone 69. Thus, after reading the depth D, the packer 70 is set, which means that the packer 70 is actuated to cause the annular seal 80 to expand to form a seal between the exterior tubular body of the packer 70 and the interior surface of the production tubing string 54. The packer 70 may include a packer setting and release tool (not shown), in some embodiments of the invention. The annular seal 80 forms the bottom of the isolation zone 69 that extends upwardly to the surface of the well.

The packer 70 may be set using a variety of different mechanisms, depending on the particular embodiment of the invention. For example, in some embodiments of the invention, the packer 70 may be a hydraulically-set packer, and in other embodiments of the invention, the packer 70 may be a weight-set packer. Thus, many variations are possible and are within the scope of the appended claims.

Thus, the setting of the packer 70 establishes the isolation zone 69 above the packer 70 to isolate the pressure of the well below the packer 70 from the surface of the well. Thus, due to this isolation, a lubricator 64 (through which the tubing string 68 extends) does not need to form a seal with the porous screen assembly. Instead, at the surface of the well, the screen assembly is deployed extends through the lubricator 64 and through a wellhead 62 of the well. After reaching the depth D, the screen assembly clears the lubricator 64 so that the screen assembly is fully received within the isolation zone 69 and the lubricator 64 forms a seal with the coiled tubing above the screen assembly.

For reasons further explained below, in some embodiments of the invention, the packer 70 may include a check valve 82, a device that permits one way flow through the central passageway of the packer 70 from the region above the check valve 82 to the region below the check valve 82. Furthermore, as depicted in FIG. 2, in some embodiments of the invention, a wash nozzle 84 may be located at the end of the packer 70 below the check valve 82. The wash nozzle 84 may be used in a wash down gravel packing operation, as further described below. In other embodiments of the invention, such as embodiments in which a wash down gravel packing operation is not used, the packer 70 may not include the wash nozzle 84.

Figure 3:
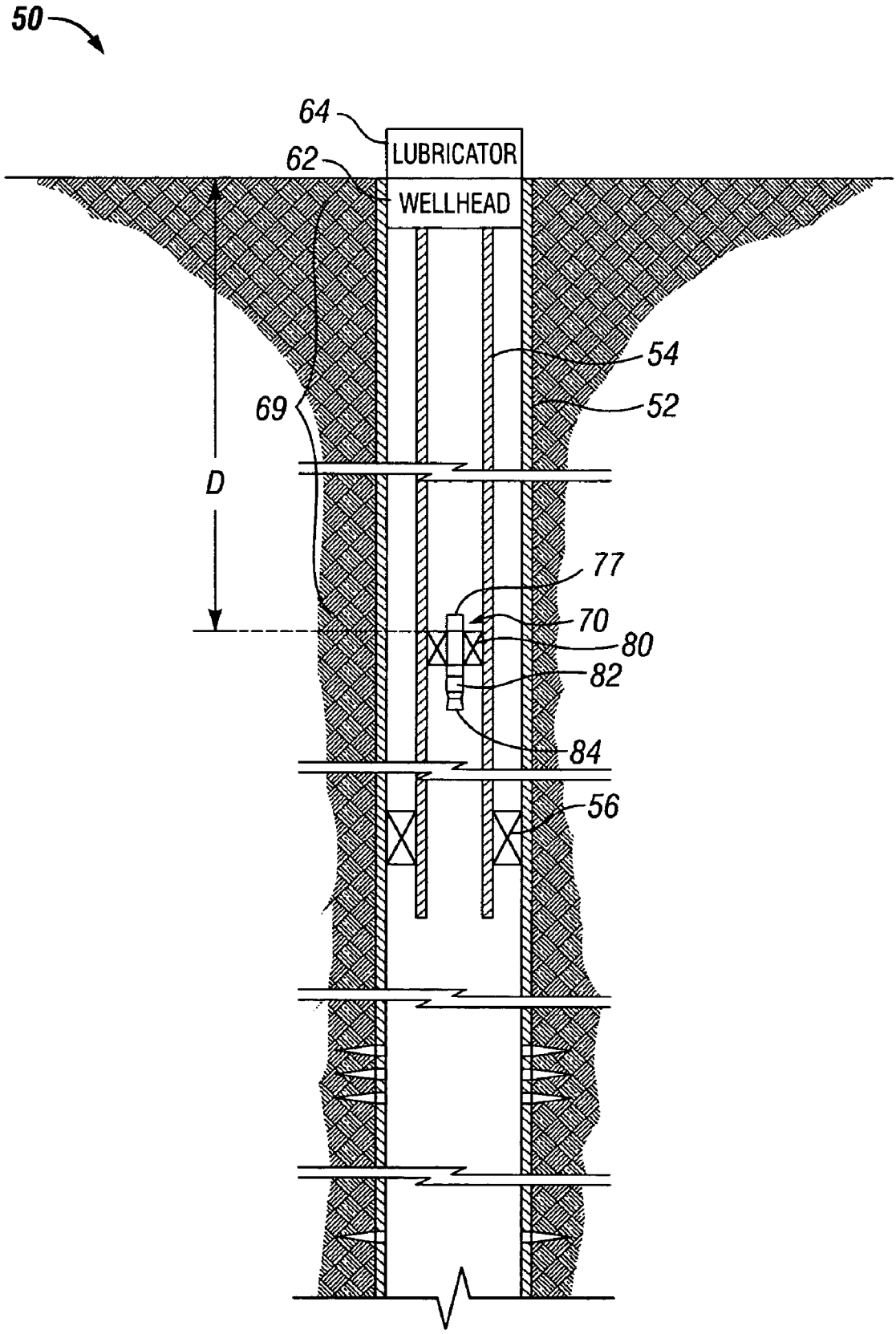

FIG. 3 depicts the well 50 after a portion 74 (FIG. 2) of the string 68 above the packer 70 has been disconnected from the packer 70 and removed from the well, leaving the set packer 70 in the well. Thus, in this state, the isolated zone 69 is formed above the packer 70.

Figure 4:
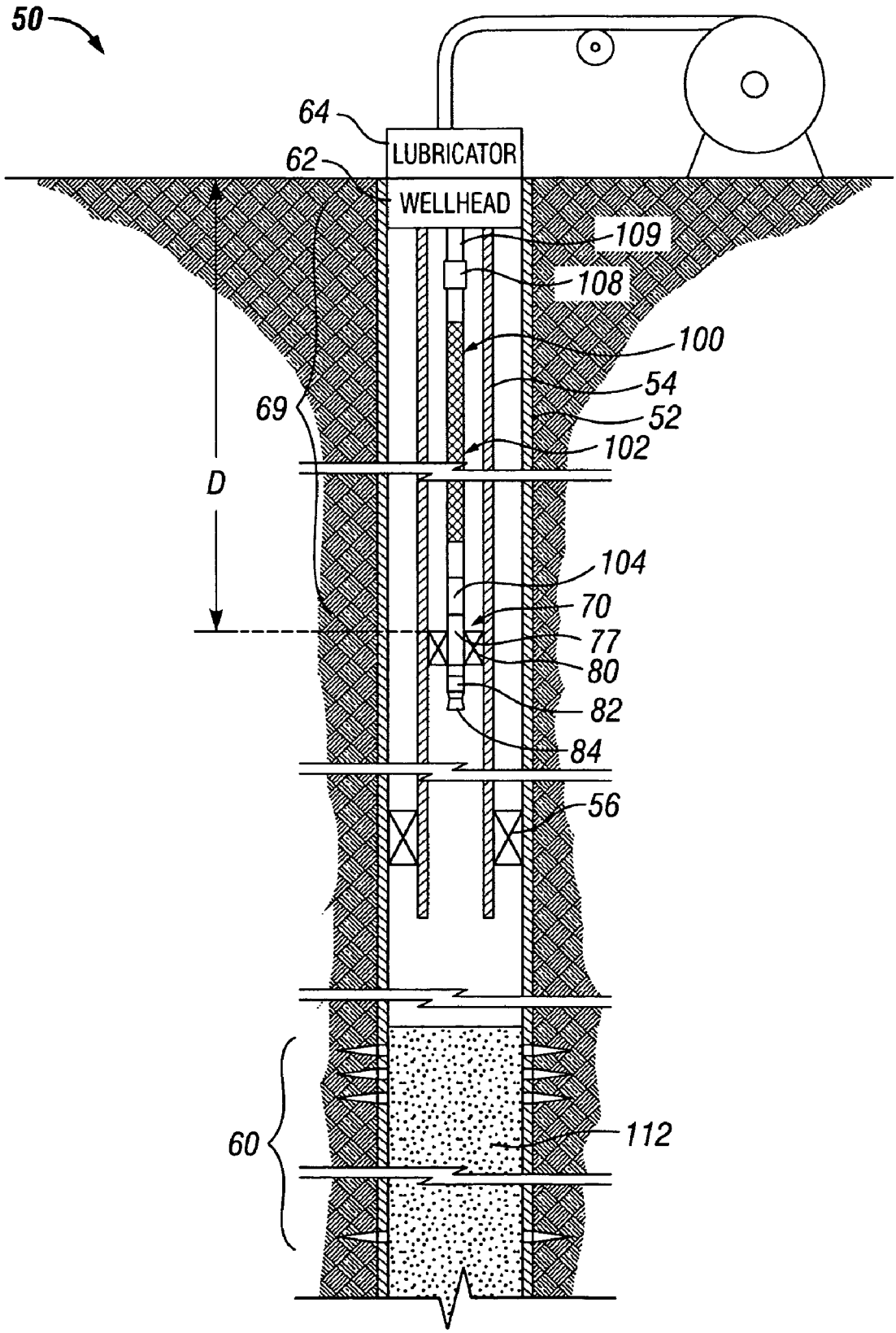
FIG. 4 is a schematic diagram of the well depicting the running of a screen assembly into an isolated region established by the isolation device according to an embodiment of the invention.

Referring to FIG. 4, taking advantage of the isolated zone 69, a screen assembly (also called a "bottom hole assembly"), such as an exemplary screen assembly 100, may be lowered into the well inside the isolated zone 69. In some embodiments of the invention, the screen assembly 100 includes, among other possible components, a retrieving, or release tool 109; a packer 108, a screen 102, and a release tool 104. The screen assembly 100 may have other and/or different components, in other embodiments of the invention.

The packer 108 (initially in an unset state) is connected to the top end of the screen 102; and the release tool 104 is connected to the lower end of the screen 102. The release tool 104 is designed to engage a mating connector 77 (a nipple, for example) of the packer 70 to lock the screen assembly 100 and the packer 70 together.

After the screen assembly 100 and the packer 70 are locked together, an upward force may then be applied to the screen assembly 100 (from the surface of the well) to lift the screen assembly 100 and produce an upward force against the packer 70 to unset the packer 70, in some embodiments of the invention. The screen assembly 100 and the unset packer 70 may then be lowered further downhole. It is noted that at this point, the lubricator 64 forms a seal between the string that contains the screen assembly 100 and the well.

In some embodiments of the invention, the screen assembly 100 (and attached packer 70) may be lowered downhole until the screen 100 is positioned inside the production zone 60. Subsequently, an annular gravel slurry flow may be pumped into the well so that the slurry flow exits the string above the screen assembly 102 and occupies the annular area between the screen 102 and the inside of the casing string 52. However, in other embodiments of the invention, a wash-down-type gravel packing operation may be used for purposes of placing gravel around the screen 102.

More specifically, in accordance with some embodiments of the invention, prior to the running of the packer 70 into the well, gravel is introduced in the well to create a region 112 of gravel inside the zone 60. Subsequently, the packer 70 and screen assembly 100 are run into the well, as described below.

Figure 5:
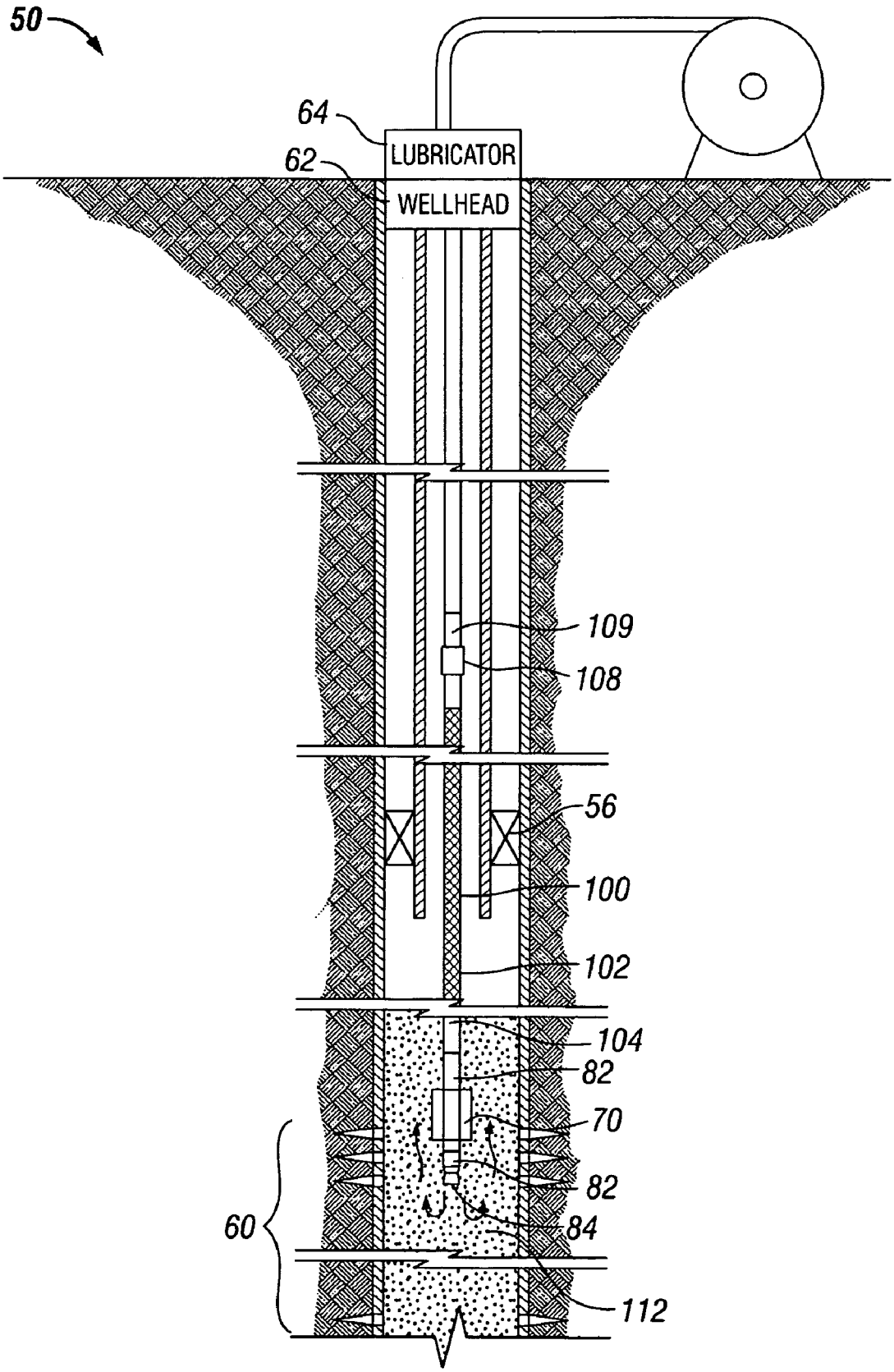
FIG. 5 is a schematic diagram of the well depicting a wash down operation in the installation of the screen assembly according to an embodiment of the invention.

Referring to FIG. 5, after the packer 70 is unset, the screen assembly 100 is lowered downhole. When the screen assembly 100 approaches the gravel region 112, a wash fluid is applied through the central passageway of the string that conveys the screen assembly 102 so that the wash fluid exits the wash nozzle 84 that is located on the lower end of the packer 70. The fluid that exits the nozzle 84, in turn, "fluidizes" the gravel in the region 112 near the nozzle 84 to lift the gravel around the screen 102. Thus, the fluid is applied as the screen assembly 100 is lowered downhole to displace the gravel in the region 112 and move the gravel in the annular area that surrounds the screen 102.

Figure 6:
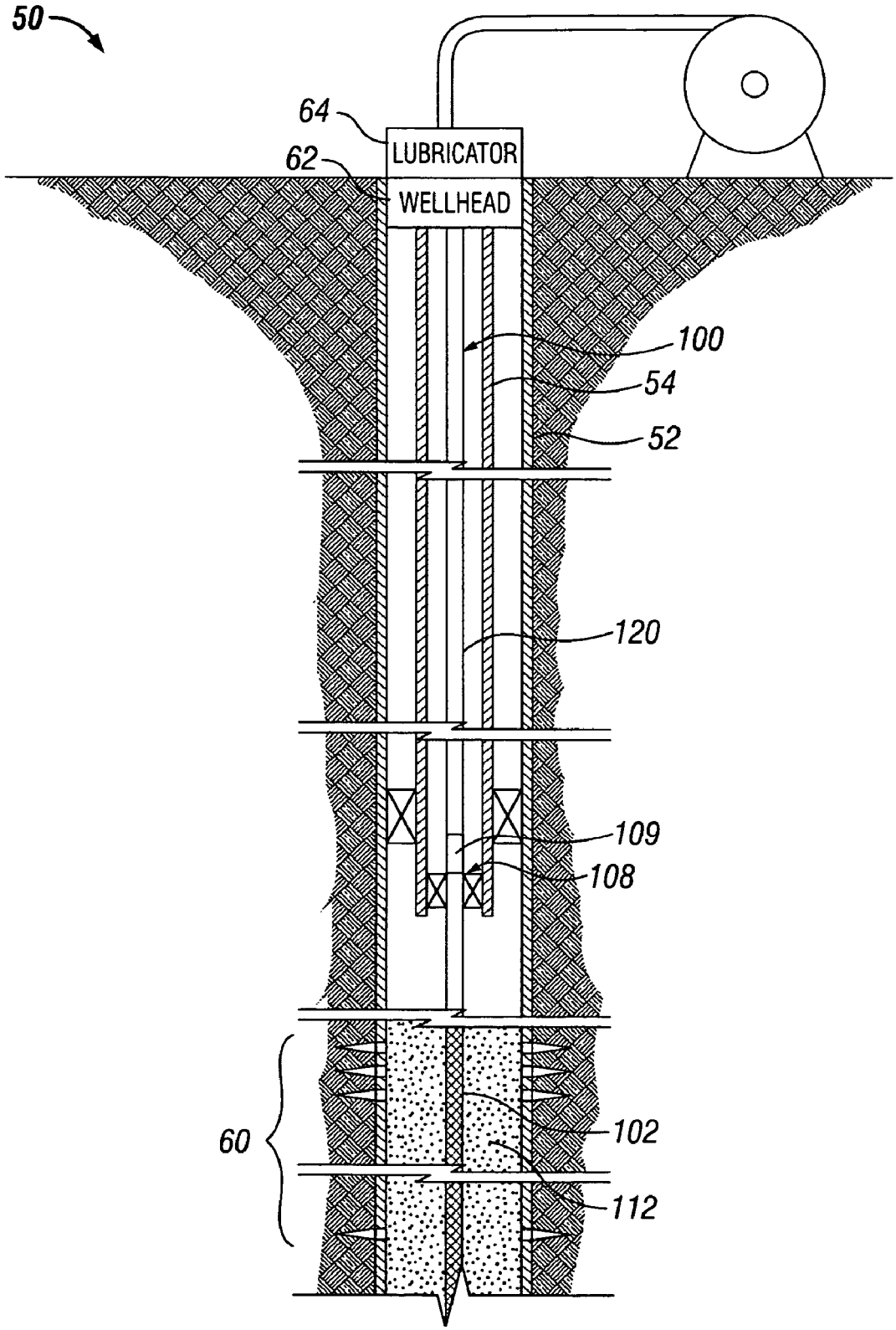
FIG. 6 is a schematic diagram of the well depicting the screen assembly in its final position according to an embodiment of the invention.
Figure 7:
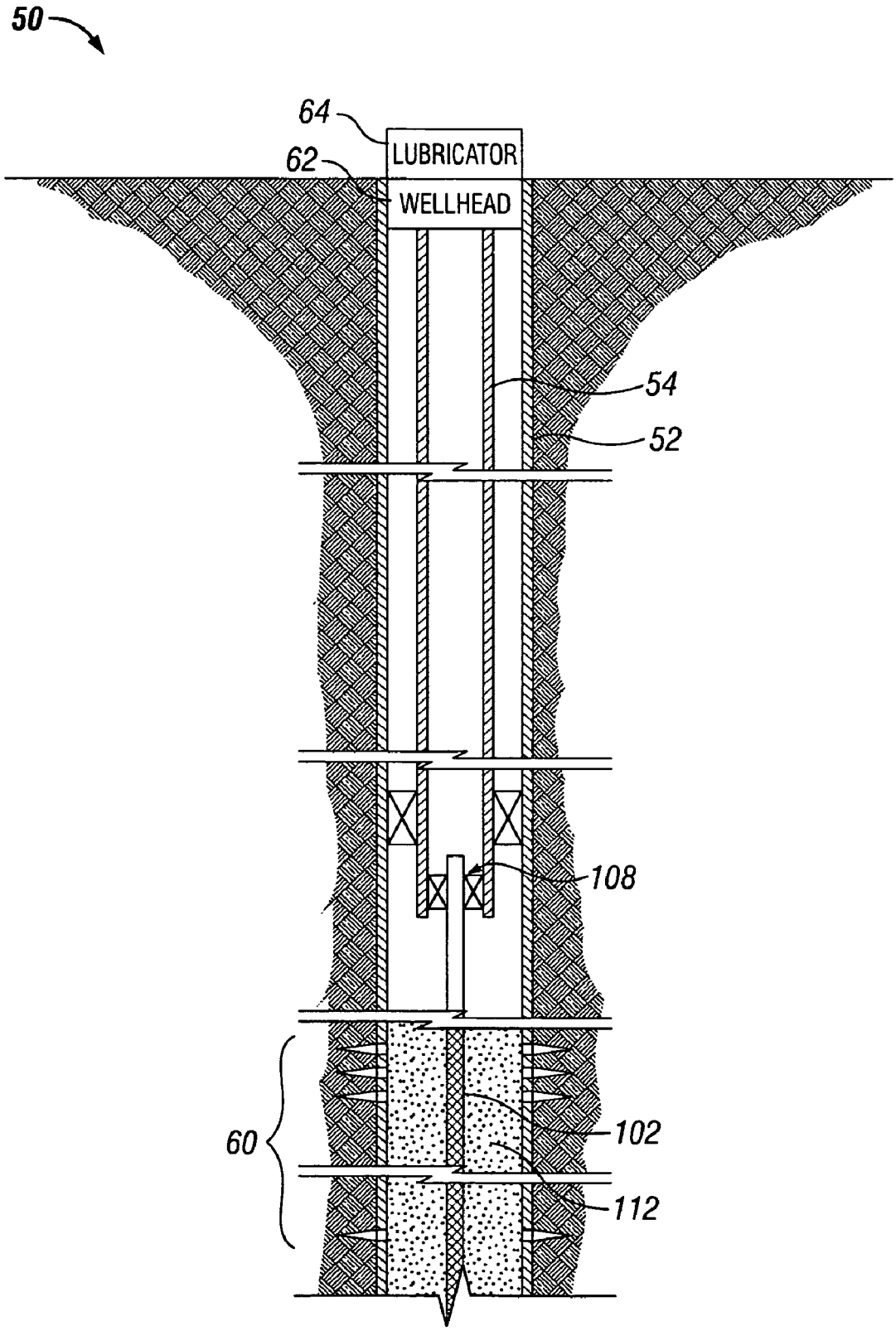
FIG. 7 is a schematic diagram of the well depicting the well in a production state according to an embodiment of the invention.

Referring to FIG. 6, at the conclusion of the above-described washdown operation, the screen 102 resides inside the zone 60, and the gravel surrounds the annular region between the screen 102 and the casing string 54. At this position of the string, the packer 108 may be set to secure the screen assembly 100 in place. In some embodiments of the invention, the screen assembly 100 includes a profile that aligns, or registers, with a corresponding profile (not depicted in FIG. 6) of the production tubing string 52 so that proper position of the screen 102 may be determined (via the weight offset, for example) at the surface of the well. When in this position, the packer 108 is set to form a seal between the screen assembly 100 and the production tubing string 54. The release tool 109, which is located above the packer 108, may then be engaged for purposes of disconnecting the portion of the string above the packer 108 from the portion of the string below the packer 108. Thus, for example, once the packer 108 is set, an upward force may be applied to the string to activate the release tool 109 for purposes of releasing the portion of the string above the packer 108 from the portion of the string below the packer 108. Thus, the string above the packer 108 may be retrieved from the well to place the well in a production state, as depicted in FIG. 7.

Figure 8:
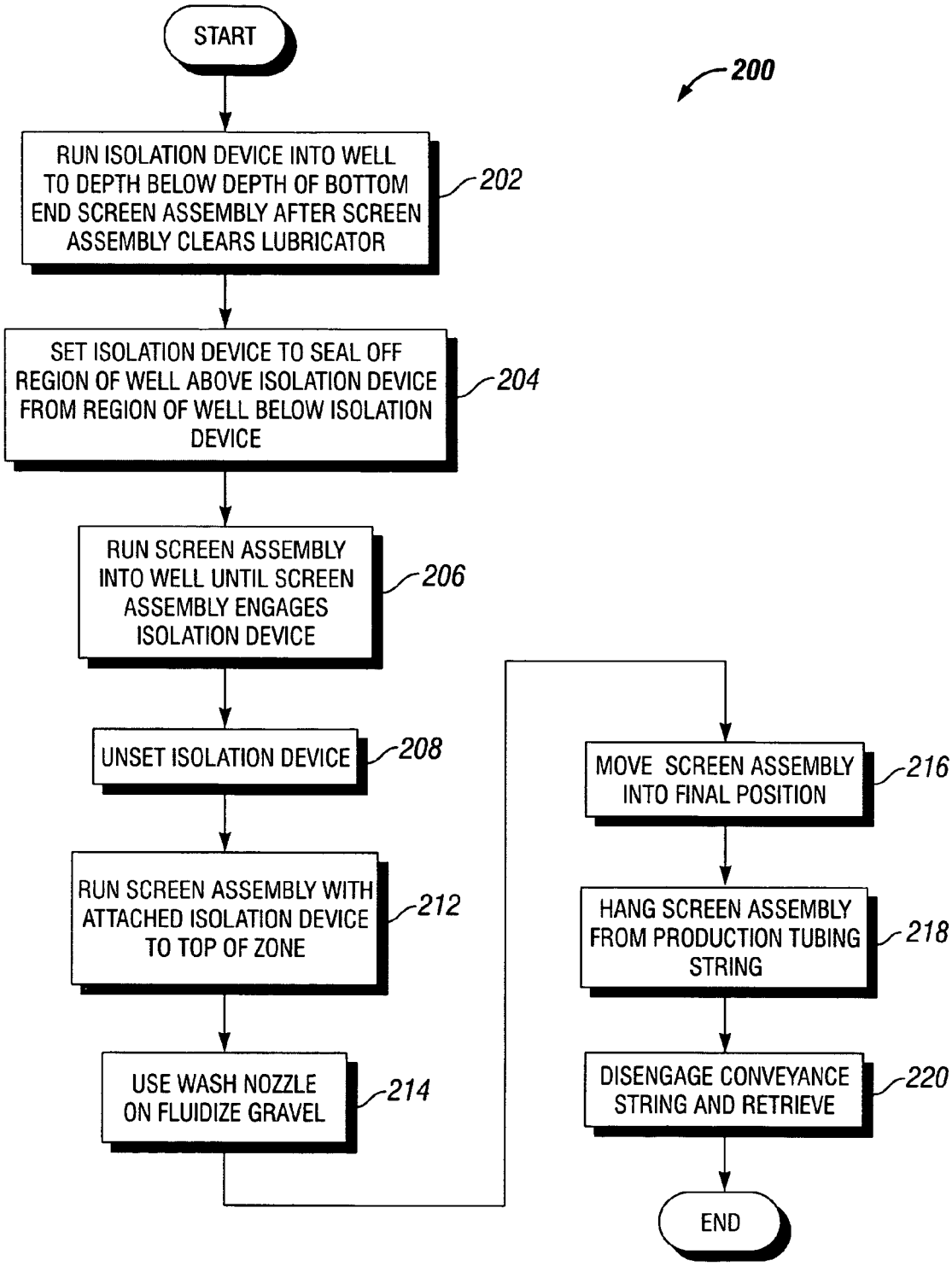
FIG. 8 depicts a flow diagram illustrating a technique to install a screen assembly in a well according to an embodiment of the invention.

To summarize, referring to FIG. 8 in accordance with some embodiments of the invention, a technique 200 may be used for purposes of installing a screen in a subterranean well. The technique 200 includes running (block 202) an isolation device into a well to a depth that is below the depth that is needed to fully receive the screen assembly in the well. Next, pursuant to the technique 200, the isolation device is set (block 204) to seal off the region of the well above the isolation device from the region of the well below the isolation device. Thus, at this point the isolation zone 69 (see FIG. 2) is established to isolate the positive pressure of the well from the surface. Next, pursuant to the technique 200, the screen assembly is run (block 206) into the well until the screen assembly engages the isolation device. The isolation device is then unset (block 208), and then, the screen assembly is run with the attached isolation device to the top of the production zone, as depicted in block 212. Subsequently, the wash nozzle on the isolation device is used to fluidize the gravel, pursuant to block 214. Then, the screen assembly is moved (block 216) into its final position. This allows the hanging (block 218) of the screen assembly from the production tubing string and the disengagement (block 220) of the conveyance string and its retrieval from the well.

In some embodiments of the invention, the wash nozzle 84 (see FIG. 2, for example) may not be present. For these embodiments of the invention, the packer 70 may be replaced by another type of seal device, such as a bridge plug or bull nose assembly. Thus, a passageway may not be present in the sealing device that forms the lower end of the isolation zone 69, in some embodiments of the invention.

Although the deployment of a screen has been discussed above, it is noted that the techniques that are described herein may be applied to assemblies other than a screen assembly. In particular, the techniques that are disclosed herein may be applied to relatively long strings that have sections that are porous and thus, present challenges in forming seals between the lubricator and these sections. For example, in other embodiments of the invention, a perforating gun string may be deployed into a well in a similar manner.

Figure 9:
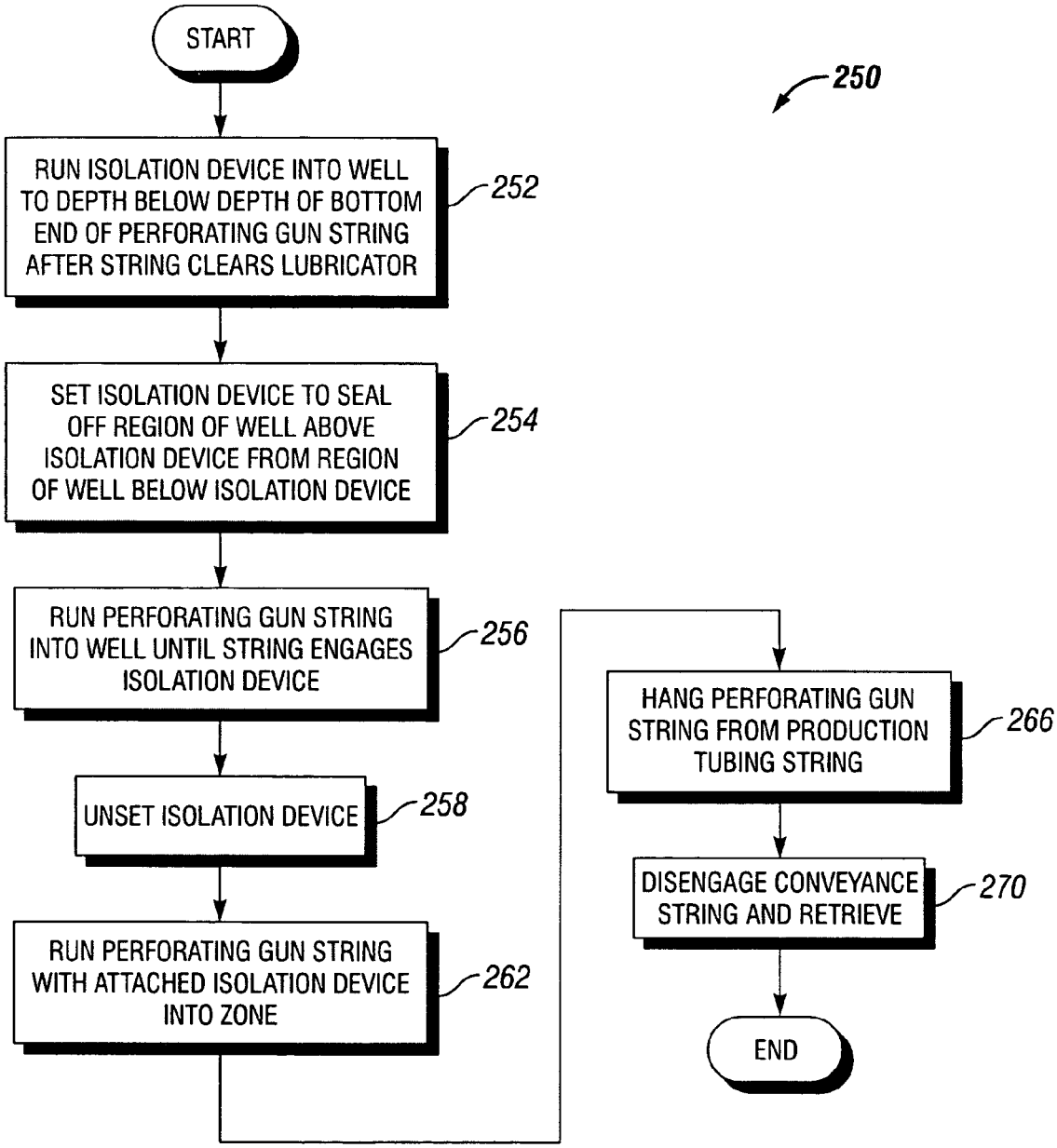
FIG. 9 depicts a flow diagram illustrating a technique to install a perforating gun string in a well according to an embodiment of the invention.

More specifically, referring to FIG. 9, a technique 250 for deploying a perforating gun string into a well includes running (block 252) an isolation device into the well to a depth that allows the perforating gun string to occupy the space above the isolation device when the perforating gun is fully received in the well. Next, the isolation device is set (block 254) seal off the surface of the well from the region below the isolation device to create the isolation zone. Subsequently, the perforating gun string is run (block 256) into the well until the string engages the isolation device. This engagement, is then used to unset (block 258) the isolation device. The perforating gun string is then run (block 262) with the attached isolation device into the zone. Subsequently, the perforating gun string may then be hanged (block 266) from the production tubing string. Lastly, the conveyance string used to run the perforating gun string into the well is disengaged (block 270) and retrieved to the surface of the well. It is noted that in some embodiments of the invention, the perforating gun string may be a tubing pressure conveyed-actuated gun in that pressure through the conveyance string may be used to fire the shaped charges of the perforating string. However, other techniques may be used to fire the perforating gun string, in accordance with other embodiments of the invention.

Although orientational and directional terms such as "upper," "lower," "up," and "down" have been used herein to simplify the preceding description, it is understood that the embodiments of the invention are not limited to the described orientations and directions. For example, in some embodiments of the invention, the above described technique and system may be used in a lateral wellbore.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

deploying a production tubing string within a well casing string in a well;

running an isolation device into the production tubing string;

using the isolation device to form a seal to create a first region in the production tubing string isolating the surface of the well from a second higher pressure region of the well;

running a screen assembly through a lubricator and into the first region without forming a seal between the screen assembly and the lubricator;

engaging the isolation device with the screen assembly to remove the seal; and after removal of the seal, running the isolation device and assembly together further into the well.

2. The method of claim 1, wherein the isolation device comprises a packer and the act of engaging comprises unsetting the packer.

3. The method of claim 1, further comprising:

clearing the lubricator of the well with an upper end of the screen assembly before the screen assembly reaches the isolation device.

4. The method of claim 1, further comprising:

withdrawing a conveyance device used in the running of the isolation device from the well after the formation of the seal and before the running of the screen assembly.

5. The method of claim 1, further comprising:

providing a check valve in the isolation device to establish one way fluid communication through the isolation device.

6. The method of claim 1, further comprising:

providing a nozzle attached to the isolation device to permit a washdown gravel packing operation.

7. The method of claim 1, wherein the isolation device comprises one of a packer and a bridge plug.

8. A method usable with a well, comprising:

running an isolation device into the well;

setting the isolation device to create a first region of the well isolating the surface of the well from a second higher pressure region of the well;

running a screen assembly through a lubricator without forming a seal between the screen assembly and the lubricator;

moving the screen assembly with a tubing string into the first region until the screen assembly reaches the isolation device;

forming a seal between the tubing string and the lubricator;

engaging the isolation device with the screen assembly to unset the isolation device; and continue running the screen assembly and the isolation device into the well.

9. The method of claim 8, further comprising:

clearing the lubricator with an upper end of the screen assembly before the screen assembly reaches the isolation device.

10. The method of claim 8, further comprising:

providing a nozzle attached to the isolation device to permit a washdown gravel packing operation.

11. The method of claim 8, wherein the screen assembly is run inside a production tubing string, the method further comprising:

forming a seal between the screen assembly and the production tubing string.

12. The method of claim 8, further comprising:

attaching a check valve to the isolation device to control fluid communication through the isolation device in response to the isolation device being set.

13. A system usable with a well, comprising:

a lubricator positioned proximate a wellhead;

a production tubing string extending downwardly from the wellhead within a well casing;

an isolation device positioned in the production tubing string to isolate a region from positive well pressure below;

a string comprising a screen assembly positioned in the region without forming a seal with the lubricator; and a release tool connected to a bottom end of the screen assembly to release a seal formed by the isolation device.

14. The system of claim 13, wherein the tool is adapted to attach the isolation device to the screen assembly to allow the screen assembly and isolation device to be run downhole together.

15. The system of claim 13, wherein the isolation device comprises a check valve to allow one way communication through the isolation device.

16. The system of claim 13, wherein the isolation device comprises a nozzle to allow fluid to be communicated through the isolation device for a wash down gravel packing operation.

17. The system of claim 13, wherein the screen assembly comprises:

a screen; and a device to form a seal between the assembly and a production tubing string.

18. A system usable with a well, comprising:

a lubricator positioned proximate a wellhead;

a tubing extending downwardly into the well from the wellhead;

an isolation device comprising a releasable packer set within the tubing, the releasable packer temporarily creating an isolated region relative to the well pressure below the releasable packer;

a string comprising an assembly positioned in the isolated region without forming a seal with the lubricator; and a release tool connected to a bottom end of the assembly to release a seal formed between the releasable packer and the surrounding tubing.

19. The system of claim 18, wherein the tool is adapted to attach the isolation device to the assembly to allow the assembly and isolation device to be run downhole together.

20. The system of claim 18, wherein the isolation device comprises a check valve to allow one way communication through the isolation device.

21. The system of claim 18, wherein the isolation device comprises a nozzle to allow fluid to be communicated through the isolation device for a wash down gravel packing operation.

22. The system of claim 18, wherein the assembly comprises one of a perforating gun string and a screen.

* * * * *